US005486297A

United States Patent [19]

Marin-Carrillo et al.

[11] Patent Number: 5,486,297

[45] Date of Patent: Jan. 23, 1996

[54] DYE FADING PROTECTION FROM SOIL RELEASE AGENTS

[75] Inventors: Edgar M. Marin-Carrillo; Luis A. Amestica; Francisco R. Figueroa, all of Caracas; Ana M. Ramirez-Semeco, El Valle, all of Venezuela

[73] Assignee: The Procter & Gamble Company, Cincinnati, Ohio

[21] Appl. No.: 259,724

[22] Filed: Jun. 14, 1994

[51] Int. Cl.[6] ..... D06M 10/08; C11D 3/37

[52] U.S. Cl. ..... 252/8.6; 252/8.7; 252/8.75; 252/8.8; 252/8.9; 252/174.21

[58] Field of Search ..... 252/8.6, 8.7, 8.75, 252/8.8, 174.21, 8.9

[56] References Cited

U.S. PATENT DOCUMENTS

| | | | |
|---|---|---|---|
| 3,959,230 | 5/1976 | Hays | 252/8.6 |
| 3,962,152 | 6/1976 | Nicol et al. | 252/8.6 |
| 4,116,885 | 9/1978 | Derstadt et al. | 252/532 |
| 4,238,531 | 12/1980 | Rudy et al. | 252/8.8 |
| 4,569,772 | 2/1986 | Ciallella | 252/8.6 |
| 4,702,857 | 10/1987 | Gosselink | 252/174.21 |
| 4,721,580 | 1/1988 | Gosselink | 252/8.7 |
| 4,764,289 | 8/1988 | Trinh | 252/8.6 |
| 4,818,569 | 4/1989 | Trinh et al. | 427/242 |
| 4,834,895 | 5/1989 | Cook et al. | 252/8.6 |
| 4,863,619 | 9/1989 | Borcher, Sr. et al. | 252/8.6 |
| 4,877,896 | 10/1989 | Maldonado et al. | 560/14 |
| 4,956,447 | 9/1990 | Gosselink et al. | 528/272 |
| 4,976,879 | 12/1990 | Maldonado et al. | 252/8.7 |
| 5,041,230 | 8/1991 | Borcher, Sr. et al. | 252/8.9 |
| 5,182,043 | 1/1993 | Morrall et al. | 252/174 |
| 5,196,133 | 3/1993 | Leslie et al. | 252/95 |
| 5,256,168 | 10/1993 | Morrall et al. | 8/137 |
| 5,415,807 | 5/1995 | Gosselink et al. | 252/174.21 |

FOREIGN PATENT DOCUMENTS

| | | |
|---|---|---|
| WO92/04433 | 3/1992 | WIPO . |
| WO95/02030 | 1/1995 | WIPO . |

*Primary Examiner*—Anthony Green
*Attorney, Agent, or Firm*—Milton B. Graff; Donald E. Hasse; Jacobus C. Rasser

[57] ABSTRACT

The present invention relates to a method for reducing dye fading of a fabric comprising depositing on the fabric a soil release agent capable of substantially absorbing ultraviolet and/or visible light (in the 200–700 nanometer wavelength range). The soil release agent is preferably deposited on the fabric during a laundering or drying operation. Preferably the weight ratio of soil release agent to fabric is between about 1:10,000 and about 1:100. The soil release agent has light-absorbing chemical structure groups which can include carbonyls, carboxylates, conjugated double bonds, and/or aromatic rings. Suitable soil release agents for use in the invention include oliogomeric, substantially linear, sulfonated poly-ethoxy/propoxy end-capped esters, which comprise oxyethyleneoxy units and terephthaloyl units.

12 Claims, No Drawings

DYE FADING PROTECTION FROM SOIL RELEASE AGENTS

TECHNICAL FIELD

The present invention relates to a method for providing dye fading protection to fabrics, and particularly the invention relates to the use of detergent formulations with soil release agents to provide this dye fading protection.

BACKGROUND OF THE INVENTION

Colored fabrics are used in the manufacture of many types of garments worn by consumers. Unfortunately the colors can fade over time upon exposure of the garments to sunlight, resulting in a less attractive appearance. This fading of colored fabrics is especially a problem when garments are dried outdoors after washing, and with garments such as sport clothes that are intended for outdoor use.

A variety of soil release agents are known for use in the laundering of garments. The soil release agents typically work by depositing on fabrics and changing their surface characteristics, making them more resistant to certain types of soils. For example, some soil release agents deposit on polyester fabrics changing their lipophilic/hydrophilic character, thereby making the fabrics less prone to fix lipophilic soils such as oils and greases.

However, while soil release agents have been known for their cleaning benefits, they have not been previously suggested for use in providing dye fading protection to fabrics.

It is an object of the present invention to provide dye fading protection to fabrics.

It is another object of the present invention to provide such dye fading protection by the use of certain kinds of soil release agents.

These and other objects are secured herein as will be seen from the following disclosure.

SUMMARY OF THE INVENTION

The present invention relates to a method for reducing dye fading of a fabric comprising depositing on the fabric a soil release agent capable of substantially absorbing ultraviolet and/or visible light (in the 200–700 nanometer wavelength range). The soil release agent is preferably deposited on the fabric during a laundering or drying operation. Preferably the weight ratio of soil release agent to fabric is between about 1:10,000 and about 1:100. The soil release agent has light-absorbing chemical structure groups which can include carbonyls, carboxylates, conjugated double bonds, and/or aromatic rings. Suitable soil release agents for use in the invention include oliogomeric, substantially linear, sulfonated poly-ethoxy/propoxy end-capped esters, which comprise oxyethyleneoxy units and terephthaloyl units.

DETAILED DESCRIPTION OF THE INVENTION

The present invention encompasses a method for reducing dye fading of a fabric comprising depositing on the fabric a soil release agent having an absorptivity of at least about $1\times10^{-5}$ (ppm-cm)$^{-1}$ in the wavelength range between about 200 nanometers and about 700 nanometers. Surprisingly, it has now been discovered that dye fading protection can be afforded to fabrics by the use of soil release agents with chemical structure groups capable of substantially absorbing light within this range—such groups can include carbonyls, carboxylates, conjugated double bonds, aromatic rings, and their combination. The soil release agents can be modified to be even more efficient in dye fading protection, for instance by further conjugation of light absorbing groups with $\alpha$, $\beta$ unsaturation and/or aromatic groups. Preferably the soil release agent has an absorptivity of at least about $1\times10^{-4}$ (ppm-cm)$^{-1}$ in the wavelength range between about 200 nanometers and about 700 nanometers, and more preferably an absorptivity of at least about $1\times10^{-2}$ (ppm-cm)$^{-1}$. Most preferably it has an absorptivity of at least about $1\times10^{-2}$ (ppm-cm)$^{-1}$ in the wavelength range between about 200 nanometers and about 400 nanometers (ultraviolet light).

Upon deposition on fabrics these soil release agents work as sun shields and reduce dye fading caused by light exposure. The dye fading protection benefit can be achieved by: 1) deposition of the soil release agent on the fabric, for example during a laundering or drying operation, or 2) incorporation of the soil release agent onto the fabric fibers during the fiber making process. Preferably the soil release agent is used as a component of a granular laundry detergent or a detergent in other product forms, for example laundry bars, pastes, gels or liquids. The soil release agent could also be a component of a fabric softener (e.g., a liquid fabric softener used during the laundering operation, or a dryer-added fabric conditioner sheet providing softening and anti-static benefits), a laundry additive, a pretreatment composition or a coating composition. The soil release agent is preferably deposited on the fabric so that the weight ratio of soil release agent to fabric is between about 1:10,000 about 1:100, more preferably between about 1:10,000 and about 1:1,000.

The dye fading protection benefit of the invention will work with any kind of fabric, including natural fibers, synthetic fibers, and natural/synthetic blends. Preferably the fabric is selected from cotton, polyesters, and blends of cotton and polyesters. Similarly, the invention will work with any colors susceptible to fading, for example red, brown, violet, or shades thereof.

Soil Release Agents

Suitable soil release agents for use in the present invention can be selected from those disclosed in U.S. Pat. Nos. 3,962,152, 4,116,885, 4,238,531, 4,702,857, 4,721,580 and 4,877,896 (all incorporated by reference herein). Additional soil release agents useful herein include the nonionic oligomeric esterification product of a reaction mixture comprising a source of $C_1$–$C_4$ alkoxy-terminated polyethoxy units (e.g., $CH_3[OCH_2CH_2]_{16}$ OH), a source of terephthaloyl units (e.g., dimethyl terephthalate); a source of poly(oxyethylene)oxy units (e.g., polyethylene glycol 1500); a source of oxyiso-propyleneoxy units (e.g., 1,2-propylene glycol); and a source of oxyethyleneoxy units (e.g., ethylene glycol) especially wherein the mole ratio of oxyethyleneoxy units:oxyiso-propyleneoxy units is at least about 0.5:1. Such nonionic soil release agents are of the general formula

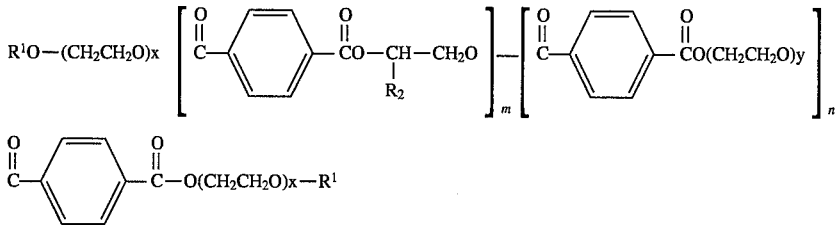

wherein $R^1$ is lower (e.g., $C_1$–$C_4$) alkyl, especially methyl; x and y are each integers from about 6 to about 100; m is an integer of from about 0.75 to about 30; n is an integer from about 0.25 to about 20; and $R^2$ is a mixture of both H and $CH_3$ to provide a mole ratio of oxyethyleneoxy:oxyisopropyleneoxy of at least about 0.5:1.

Another suitable type of soil release agent useful herein is of the general anionic type described in U.S. Pat. No. 4,877,896, but with the condition that such agents be substantially free of monomers of the HOROH type wherein R is propylene or higher alkyl. Thus, the soil release agents of U.S. Pat. No. 4,877,896 can comprise, for example, the reaction product of dimethyl terephthalate, ethylene glycol, 1,2-propylene glycol and 3-sodiosulfobenzoic acid, whereas these additional soil release agents can comprise, for example, the reaction product of dimethyl terephthalate, ethylene glycol, 5-sodiosulfoisophthalate and 3-sodiosulfobenzoic acid.

Polymeric soil release agents useful in the present invention include cellulosic derivatives such as hydroxyether cellulosic polymers, copolymeric blocks of ethylene terephthalate or propylene terephthalate with polyethylene oxide or polypropylene oxide terephthalate, and the like. Cellulosic derivatives that are functional as soil release agents are commercially available and include hydroxyethers of cellulose such as Methocel® (Dow). Cellulosic soil release agents for use herein also include those selected from the group consisting of $C_1$– $C_4$ alkyl and $C_4$ hydroxyalkyl cellulose such as methylcellulose, ethylcellulose, hydroxypropyl methylcellulose, and hydroxybutyl methylcellulose. A variety of cellulose derivatives useful as soil release polymers are disclosed in U.S. Pat. No. 4,000,093, issued Dec. 28, 1976 to Nicol, et al., incorporated herein by reference.

Soil release agents characterized by poly(vinyl ester) hydrophobe segments include graft copolymers of poly(vinyl ester), e.g., $C_1$ –$C_6$ vinyl esters, preferably poly(vinyl acetate) grafted onto polyalkylene oxide backbones, such as polyethylene oxide backbones. Such materials are known in the art and are described in European Patent Application 0 219 048, published Apr. 22, 1987 by Kud, et al. Suitable commercially available soil release agents of this kind include the Sokalan™ type of material, e.g., Sokalan™ HP-22, available from BASF (West Germany).

One type of suitable soil release agent is a copolymer having random blocks of ethylene terephthalate and polyethylene oxide (PEO) terephthalate. More specifically, these polymers are comprised of repeating units of ethylene terephthalate and PEO terephthalate in a mole ratio of ethylene terephthalate units to PEO terephthalate units of from about 25:75 to about 35:65, said PEO terephthalate units containing polyethylene oxide having molecular weights of from about 300 to about 2000. The molecular weight of this polymeric soil release agent is in the range of from about 25,000 to about 55,000. See U.S. Pat. No. 3,959,230 to Hays, issued May 25, 1976, which is incorporated by reference.

U.S. Pat. No. 4,569,772 to Ciallella, issued Feb. 11, 1986 (incorporated by reference herein), discloses a soil release agent which comprises particles obtained by making a melt of PET-POET (polyethylene terephthalatepolyoxyethylene terephthalate) polymer and water soluble alkali metal polyacrylate and converting it to particulate solid form. Preferably the soil release agent contains a PET-POET polymer of a molecular weight in the range of 15,000 to 50,000, the polyoxyethylene of the POET is of a molecular weight in the range of 1,000 to 10,000, the molar ratio of ethylene terephthalate to POET units is within the range of 2:1 to 6:1, and the alkali metal polyacrylate is sodium polyacrylate of a molecular weight in the range of about 1,000 to 5,000.

U.S. Pat. No. 4,721,580 to Gosselink, issued Jan. 26, 1988 (incorporated by reference herein), discloses soil release agents comprising oligomeric esters and mixtures thereof. Preferred oligomers have the formulae

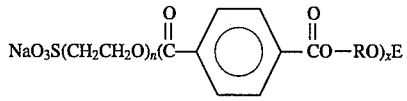

wherein E is

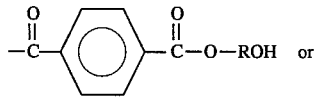

or

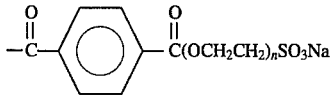

wherein the R substitutents may be the same or different and are members selected from the group consisting of —$CH_2CH(CH_3)$—, —$CH(CH_3)CH_2$— and —$CH_2CH_2$—, n is an integer from 1 to 30 and x is an integer from 0 to about 20 provided that when E is

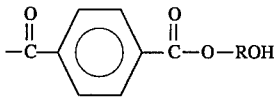

x is at least 1. Mixtures of the oligomers having one and two $NaO_3S(CH_2CH_2O)_n$— substituents are preferred.

U.S. Pat. No. 4,764,289 to Trinh, issued Aug. 16, 1988, and U.S. Pat. No. 4,956,447 to Gosselink et al., issued Sep. 11, 1990 (both incorporated by reference herein), disclose solid, high-melting anionic polymeric (or oligomeric) soil release agents having at least one basically hydrophobic moiety, preferably a polyester comprising terephthaloyl groups and oxyalkyleneoxy groups, and having one or more hydrophilic moieties comprising anionic groups, especially sulfonate groups, and most especially sulfoaroyl groups and sulfopoly(oxyethylene) groups [$MO_3S$—$(CH_2CH_2O)_n$— wherein M is a compatible cation and n is from about 1 to about 25]; and, optionally but also preferably, one or more poly(oxyethylene) groups; said solid, high-melting anionic polymeric soil release agent being at least partially coated with at least an effective amount of nitrogenous polymeric coating agent.

U.S. Pat. No. 4,818,569 to Trinh et al., issued Apr. 4, 1989 (incorporated by reference herein), discloses an anionic polymeric soil release agent having at least one hydrophobic moiety and at least one hydrophilic anionic moiety where preferably the anionic polymeric soil release agent comprises at least one hydrophobic moiety comprising alternating terephthaloyl groups and groups having the formula —ORO— wherein each R is an alkylene group containing from 2 to about 6 carbon atoms, and at least one hydrophilic anionic moiety comprises at least one sulfonate group.

U.S. Pat. No. 4,863,619 to Borcher, Sr. et al., issued Sep. 5, 1989, U.S. Pat. No. 4,877,896 to Maldonado et al., issued Oct. 31, 1989, and U.S. Pat. No. 4,976,879 to Maldonado et al., issued Dec. 11, 1990 (all incorporated by reference herein), disclose oligomeric or low molecular weight polymeric, substantially linear, sulfoaroyl end-capped esters, comprising unsymmetrically substituted oxy-1,2-alkyleneoxy units, and terephthaloyl units, in a mole ratio of oxy-1,2-alkyleneoxy to terephthaloyl ranging from about 2:1 to about 1:24. (Mixtures of such esters with reaction by-products and the are suitable when they contain at least 10% by weight of said linear, end-capped esters.) The preferred esters are of relatively low molecular weight (i.e., outside the range of fiber-forming polyesters) typically ranging from about 500 to about 20,000.

U.S. Pat. No. 5,041,230 to Borcher, Sr., et al., issued Aug. 20, 1991, and U.S. Pat. No. 4,834,895 to Cook et al., issued May 30, 1989 (both incorporated by reference herein) disclose polymeric soil release agents that include block copolymers of polyalkylene terephthalate and polyoxyethylene terephthalate, block copolymers of polyalkylene terephthalate and polyethylene glycol, and hydroxyether cellulosic polymers. Preferably, the polymeric soil release agents contain one, or more, negatively charged functional groups such as the sulfonate functional group, preferably as capping groups at the terminal ends of said polymeric soil release agent.

U.S. Pat. No. 5,182,043 to Morrall et al, issued Jan. 26, 1993, U.S. Pat. No. 5,196,133 to Leslie et al., issued Mar. 23, 1993, and U.S. Pat. No. 5,256,168 to Morrall et al., issued Oct. 26, 1993 (all incorporated by reference herein) disclose oligomeric or low molecular weight polymeric, substantially linear, sulfobenzoyl end-capped esters comprising oxy-1,2-alkyleneoxy units and terephthaloyl units, in a mole ratio of said oxy-1,2-alkyleneoxy units to said terephthaloyl units ranging from about 2:1 to about 1.1:1. (Mixtures of such esters with reaction by-products and the like are suitable when at least 50 mole % of the end-capping groups are sulfobenzoyl groups.) The esters are of relatively low molecular weight (i.e., outside the range of fiber-forming polyesters), typically with averages ranging from about 650 to about 2,500.

PCT Publication Number WO 92/04433, published Mar. 19, 1992, discloses soil release agents for granular laundry detergents which are reaction products of transesterifying and oligomerizing mixtures of monomers having the functions $MO_3SC_6H_4C(O)$—, $M'O_3SC_6H_3\{C(O)O—\}_2$, —$(O)CC_6H_4C(O)$— and —$OCH_2CH_2O$— wherein M and M' are independently selected from lithium, potassium and sodium; said mixtures having a mole ratio of $MO_3SC_6H_4C(O)$— to —$(O)CC_6H_4C(O)$— of from about 0.2:1 to about 1.4:1, a mole ratio of $MO_3SC_6H_4C(O)$— to $M'O_3SC_6H_3\{C(O)O—\}_2$ of from about 0.67:1 to about 20:1 and a mole ratio of $MO_3SC_6H_4C(O)$— to — $OCH_2CH_2O$— of from about 0.007:1 to about 0.51:1, and being substantially free from monomers of formula HOROH wherein R is propylene or higher alkyl.

Another suitable soil release agent comprises at least about 10% of a substantially linear end-capped ester having molecular weight ranging from about 500 to about 8,000; said ester consisting essentially of, on a molar basis:

i) from about 1 to about 2 moles of two or more types of end-capping units selected from the group consisting of:
   a) ethoxylated or propoxylated hydroxy-ethane and propanesulfonate end-capping units of the formula $(MO_3S)(CH_2)_m(CH_2CH_2O)(RO)_n$—, wherein M is a salt-forming cation such as sodium or tetraalkylammonium, R is ethylene or propylene or a mixture thereof, m is 0 or 1, and n is from 0 to 4;
   b) sulfoaroyl units of the formula —$(O)C(C_6H_4)(SO_3M)$, wherein M is a salt forming cation;
   c) modified poly(oxyethylene)oxy monoalkyl ether units of the formula $XO(CH_2CH_2O)_k$—, wherein X contains from about 1 to about 4 carbon atoms and k is from about 1 to about 100; and
   d) ethoxylated or propoxylated phenolsulfonate end-capping units of the formula $NaO_3S(C_6H_4)(RO)_n$—, wherein n is from 1 to 5 and R is ethylene or propylene or a mixture thereof;

ii) from about 0.5 to about 66 moles of units selected from the group consisting of:
   a) oxyethyleneoxy units;
   b) oxy-1,2-propyleneoxy units; and
   c) mixtures of a) and b);

iii) from 0 to about 50 moles of di(oxyethylene)oxy units;

iv) from 0 to about 50 moles of poly(oxyethylene)oxy units with a degree of polymerization of at least 3;

v) from about 1.5 to about 40 moles of terephthaloyl units;

vi) from about 0.05 to about 26 moles of 5-sulfoisophthaloyl units of the formula —$(O)C(C_6H_3)(SO_3M)C(O)$—, wherein M is a salt forming cation such as an alkali metal or tetraalkylammonium ion; such that the total units of ii), iii), and iv) ranges from about 0.5 to about 66 moles and such that no more than 50% by weight of the ester is derived from the poly(oxyethylene)oxy units and modified poly(oxyethylene)oxy end-capping units and such that the total of units iii) and iv) is no more than 75% of the total of units ii), iii), and iv).

Oligomer Soil Release Agents

Certain oligomer soil release agents provide excellent dye fading protection and efficient deposition on fabrics. These soil release agents are esters characterized as oligomers which comprise a substantially linear ester "backbone" and essential end-capping units which are derived from sulfonated monohydroxy poly-ethoxy/propoxy monomers, especially 2-( 2-hydroxyethoxy)ethanesulfonate. The essential end-capping units are anionic hydrophiles derived from sulfonated poly-ethoxy/propoxy groups and connected to the esters by an ester linkage. The preferred end-capping units are of the formula $(MO_3S)(CH_2)_m(CH_2CH_2O)(RO)_n$ wherein M is a salt-forming cation such as sodium or tetraalkylammonium, m is 0 or 1, R is ethylene, propylene, or a mixture thereof, and n is from 0 to 2; and mixtures thereof.

Certain noncharged, hydrophobic aryldicarbonyl units are essential in the backbone unit of the oligoesters herein. Preferably, these are exclusively terephthaloyl units. Other noncharged, hydrophobic dicarbonyl units, such as isophthaloyl, adipoyl or the like, can also be present if desired.

It is also preferred to incorporate additional hydrophilic units into the backbone units of said esters. For example, anionic hydrophilic units capable of forming two ester bonds can be used. Suitable anionic hydrophilic units of this specific type are well illustrated by sulfonated dicarbonyl units, such as sulfoisophthaloyl, i.e., —(O)C($C_6H_3$)($SO_3M$)C(O)— wherein M is a salt-forming cation such as an alkali metal or tetraalkylammonium ion.

Thus, preferred esters herein comprise, per mole of said ester:

i) from about 1 to about 2 moles of sulfonated poly-ethoxy/propoxy end-capping units of the formula ($MO_3S$)($CH_2$)$_m$($CH_2CH_2O$)(RO)$_n$— wherein M is a salt-forming cation such as sodium or tetraalkylammonium, m is 0 or 1, R is ethylene, propylene or a mixture thereof, and n is from 0 to 2; and mixtures thereof;

ii) from about 0.5 to about 66 moles of units selected from the group consisting of:

a) oxyethyleneoxy units;

b) a mixture of oxyethyleneoxy and oxy-1,2-propyleneoxy units wherein said oxyethyleneoxy units are present in an oxyethyleneoxy to oxy-1,2-propyleneoxy mole ratio ranging from 0.5:1 to about 10:1; and c) a mixture of a) or b) with poly(oxyethylene)oxy units wherein said poly(oxyethylene)oxy units have a degree of polymerization of from 2 to 4; provided that when said poly(oxyethylene)oxy units have a degree of polymerization of 2, the mole ratio of poly(oxyethylene)oxy units to total group ii) units ranges from 0:1 to about 0.33:1; and when said poly(oxyethylene)oxy units have a degree of polymerization of 3, the mole ratio of poly(oxyethylene)oxy units to total group ii) units ranges from 0:1 to about 0.22:1; and when said poly(oxyethylene)oxy units have a degree of polymerization of 4, the mole ratio of poly(oxyethylene)oxy units to total group ii) units ranges from 0:1 to about 0.14:1;

iii) from about 1.5 to about 40 moles of terephthaloyl units; and iv) from 0 to about 26 moles of 5-sulfoisophthaloyl units of the formula —(O)C($C_6H_3$)($SO_3M$)C(O)— wherein M is a salt forming cation such as an alkali metal or tetraalkylammonium ion.

The end-capping sulfonated poly-ethoxy/propoxy units used in these esters are preferably sodium 2-(2-hydroxyethoxy)ethanesulfonate. Preferred end-capped esters herein are essentially in the doubly end-capped form, comprising about 2 moles of said end-capping units per mole of said ester. Examples of end-capping groups include sodium isethionate, sodium 2-( 2-hydroxyethoxy)ethanesulfonate, sodium 2-[2-(2-hydroxyethoxy)ethoxy] ethanesulfonate, sodium 5ohydroxy-4- methyl- 3-oxa-pentanesulfonate, sodium alpha- 3-sulfopropyl-omega-hydroxy-poly-(oxy-1, 2-ethanediyl) (with average degree of ethoxylation of 1–2), sodium 5- hydroxy-3-oxa-hexanesulfonate, and mixtures thereof.

The ester "backbone" of these soil release agents, by definition, comprises all the units other than the end-capping units; all the units incorporated into the esters being interconnected by means of ester bonds. Preferably, in embodiments wherein the ester "backbones" comprise only terephthaloyl units and oxyethyleneoxy units, the terephthaloyl units iii) range from about 1 to about 10 moles per ester. In preferred embodiments incorporating oxy- 1,2-propyleneoxy units, the ester "backbone" comprises terephthaloyl units, oxyethyleneoxy, and oxy-1,2-propyleneoxy units; the mole ratio of the latter two types of unit ranging from about 0.5:1 to about 10:1.

In still other highly preferred embodiments, hydrophilic units such as 5-sulfoisophthaloyl are present in the backbone and generally will comprise from about 0.05 to about 26 moles per mole of said ester.

The poly(oxyethylene)oxy units, which aid in the rate of dissolution of the ester, will typically constitute from 0 to about 25 mole percent of total oxyalkyleneoxy units per ester depending upon the degree of polymerization of the poly(oxyethylene)oxy units and the length of the ester backbone.

These soil release agents are well illustrated by one comprising from about 25% to about 100% by weight of ester having the empirical formula $(CAP)_x(EG/PG)_y(T)_z$; wherein (CAP) represents the sodium salt form of said end-capping units i); (EG/PG) represents said oxyethyleneoxy, oxy- 1,2-propyleneoxy, and poly(oxyethylene)oxy units ii); (T) represents said terephthaloyl units iii); x is from about 1 to 2; y is from about 0.5 to about 7; z is from about 1.5 to about 7; wherein x, y, and z represent the average number of moles of the corresponding units per mole of said ester. More preferably, the oxyethyleneoxy:oxy- 1,2-propyleneoxy mole ratio ranges from about 1:1 to about 10:1; x is about 2, y is from about 1 to about 6, and z is from about 2 to about 6. Most highly preferred of these ester compositions comprise at least 50% by weight of said ester molecules (oligomers) having molecular weights ranging from about 500 to about 5,000.

The aforesaid $(CAP)_x(EG/PG)_y(T)_z$ linear esters can be prepared by a process most preferably comprising reacting dimethyl terephthalate, ethylene glycol, 1,2-propylene glycol, and a compound selected from the group consisting of monovalent cation salts of sulfonated poly-ethoxy/propoxy monomers, in the presence of at least one conventional transesterification catalyst such as tetrabutyl titanate and preferably one or more crystallization-reducing stabilizer (discussed below). Additional reactants can be selected from the group consisting of diethylene glycol, triethylene glycol, tetraethylene glycol, and mixtures thereof.

As disclosed hereinabove, the backbone of the esters herein are preferably modified by incorporation of hydrophiles such as 5-sulfoisophthalate. This provides compositions such as those comprising from about 25 to about 100% by weight of ester having the empirical formula $(CAP)_x(EG/PG)_y(T)_z(SIP)_q$ wherein (CAP), (EG/PG), and (T) are as defined above and (SIP) represents the sodium salt form of said 5-sulfoisophthaloyl units iv); x is from about 1 to 2; y is from about 0.5 to about 66; z is from about 1.5 to about 40; q is from about 0.05 to about 26; the oxyethyleneoxy: oxy-1,2-propyleneoxy mole ratio ranges from about 0.5:1 to about 10:1; wherein x, y, z and q represent the average number of moles of the corresponding units per mole of said ester.

More preferably in compositions of this type, x is about 2, y is from about 3 to about 18, z is from about 3 to about 15, and q is from about 0.5 to about 4. In the most highly preferred soil release agents, x is about 2, y is about 5, z is about 5, and q is about 1.

Preferably at least about 50% by weight of said ester has a molecular weight ranging from about 500 to about 5,000.

In a preferred synthesis and composition in accordance with the above defined numbers of units, water-soluble or dispersible ester mixtures are prepared by reacting dimethyl terephthalate or terephthalic acid, ethylene glycol, 1,2-propylene glycol, a dimethyl 5-sulfoisophthalate monovalent cation salt or 5-sulfoisophthalic acid, monovalent salt, and a monohydroxy compound selected from the group consisting of monovalent cation salts of sulfonated polyethoxy/propoxy monomers, in the presence of at least one conventional esterification/transesterification catalyst and preferably one or more stabilizers.

The esters are all "substantially linear" in the sense that they are not significantly branched or crosslinked by virtue of the incorporation into their structure of units having more than two ester-bond forming sites. Furthermore, no cyclic esters are essential but may be present in the compositions at low levels (not exceeding about 2%) as a result of side-reactions during ester synthesis. Contrasting with the above, the term "substantially linear" as applied to the esters to herein does, however, expressly encompass materials which contain side chains which are unreactive in ester-forming or transesterification reactions. Optional units in the esters can likewise have side-chains, provided that they conform with the same nonreactivity criterion.

The following structures are illustrative of structures of ester molecules falling within the foregoing preferred embodiments, and demonstrate how the units are connected:

a) doubly end-capped ester molecule comprised of the essential units i), ii) and iii);

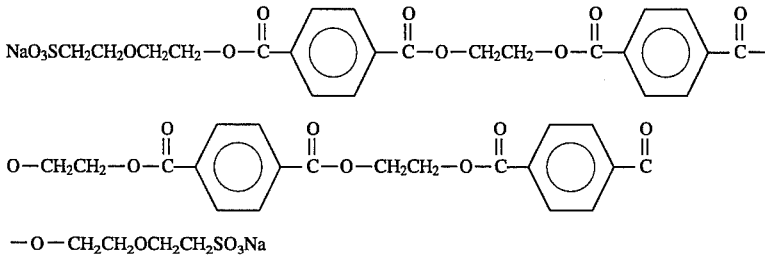

b) singly end-capped ester molecule comprised of essential units i), ii) and iii);

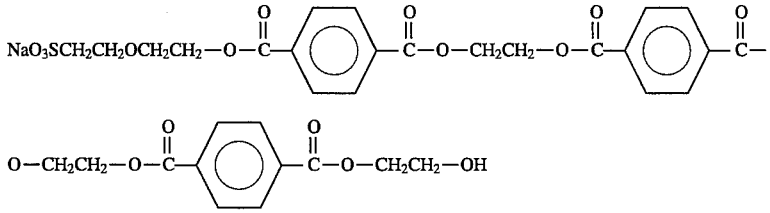

c) doubly end-capped ester molecule (termed a "hybrid backbone" ester molecule herein) comprised of essential units i), ii) and iii). Units ii) are a mixture of oxyethyleneoxy and oxy-1,2-propyleneoxy units, in the example shown below at a 2:1 mole ratio (on average, in ester compositions as a whole in contrast to individual molecules such as illustrated here, ratios ranging from about 1:1 to about 10:1 are the most highly preferred when the compositions are based on the units i), ii) and iii));

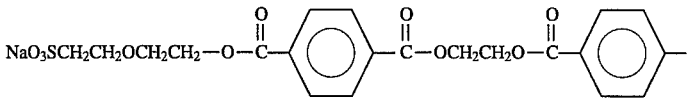

-continued

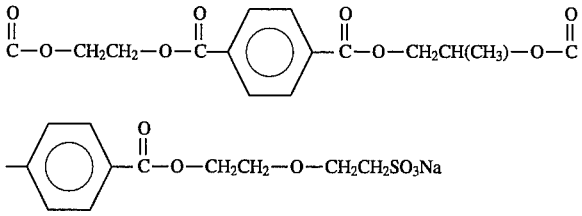

d) doubly end-capped ester molecule comprised of essential units i), ii) and iii), together with a preferred optional unit iv). On average, in ester compositions as a whole in contrast to individual molecules such as illustrated below, the most highly preferred ratios of oxyethyleneoxy to oxy- 1,2-propyleneoxy units range from about 0.5:1 to 1:0 when the compositions are based on units i), ii), iii), and iv);

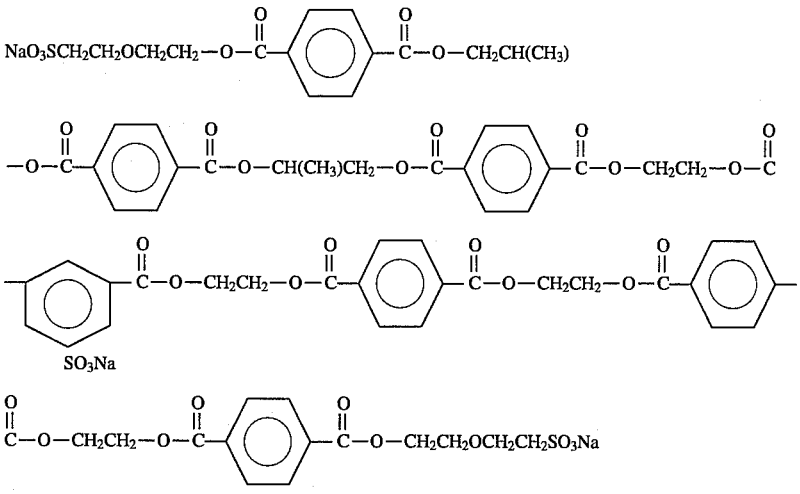

In the context of these structures of ester molecules disclosed herein it should be recognized that when the number of monomer units or ratios of units are given, the numbers refer to an average quantity of monomer units present in oligomers of the composition.

These soil release agents preferably contain from about 0.5% to about 20% stabilizing agents, more preferably from about 3% to about 20%, to reduce any difficulties attributable to undesirable crystallization of the oligomer during preparation and/or after introduction into the wash liquor. Suitable stabilizing agents include sulfonate-type hydrotropes, linear or branched alkylbenzenesulfonates, paraffin sulfonates, and other thermally-stable alkyl sulfonate variations with from about 4 to about 20 carbon atoms. Preferred agents include sodium dodecyl-benzenesulfonate, sodium cumenesulfonate, sodium toluenesulfonate, sodium xylenesulfonate, and mixtures thereof.

Use of Soil Release Agents in Detergents and Fabric Conditioners

The soil release agents can be used with conventional detersive and fabric-conditioner ingredients (such as those found in granular detergents and dryer-added sheets, respectively). The soil release agents will typically constitute from about 0.1% to about 10% by weight of a granular detergent and from about 1% to about 70% by weight of a dryer-added sheet. See the following patents, all incorporated herein by reference, for detailed illustrations of granular detergent compositions and articles, such as dryer-added sheets, suitable for use in combination with the soil release agents; these patents include disclosures of types and levels of typical detersive surfactants and builders, as well as of fabric conditioner active ingredients useful herein: U.S. Pat. No. 3,985,669, Krummel et al., issued Oct. 12, 1976; U.S. Pat. No. 4,379,080, Murphy, issued Apr. 5, 1983; U.S. Pat. No. 4,490,271, Spadini et al., issued Dec. 25, 1984 and U.S. Pat. No. 4,605,509, Corkill et al., issued Aug. 12, 1986 (in the foregoing, granular detergent compositions have non-phosphorus builder systems; other non-phosphorus builders usable herein are the compounds tartrate monosuccinate/tartrate disuccinate, disclosed in U.S. Pat. No. 4,663,071, Bush et al., issued May 5, 1987 and 2,2-oxodisuccinate, disclosed in U.S. Pat. No 3,128,287, Berg, issued Apr. 7, 1964). Phosphorus-containing builders well-known in the art can also be used, as can bleaches; see U.S. Pat. No. 4,412,934, Chung et al., issued Nov. 1, 1983. Articles for use in automatic tumble-dryers are illustrated in more detail in U.S. Pat. No. 3,442,692, Gaiser, issued May 6, 1969; U.S. Pat. No. 4,103,047, Zaki et al., issued Jul. 25, 1978 and U.S. Pat. No. 3,686,025, Morton issued Aug. 22, 1972.

The present soil release agents are preferably used at aqueous concentrations ranging from about 1 to about 50 ppm, preferably about 5 to about 30 ppm, to provide effective deposition on fabrics washed in an aqueous, preferably alkaline (pH range about 7 to about 11, more preferably about 9 to about 10.5) environment, in the presence of typical granular detergent ingredients; including anionic surfactants, phosphate, ether carboxylate or zeolite builders, and various commonly used ingredients such as bleaches, enzymes and optical brighteners. Although a single laundry/ use cycle is suitable, best results are obtained using two or more cycles comprising the ordered sequence of steps:

(a) contacting said fabrics with said aqueous laundry liquor in a conventional automatic washing machine or by hand-washing for periods ranging from about 5 minutes to about 1 hour;

(b) rinsing said fabrics with water;

(c) line- or tumble-drying said fabrics; and (d) exposing said fabrics to sunlight through normal wear.

Absorptivity

As understood by persons skilled in the art, "absorptivity" is a measure of the absorption intensity of a material, defined as the absorbance per unit concentration per unit length of light path. It is a constant for each absorbing material at specific wavelength and designated concentration, e.g., ppm. Under Beer's law, A=log 1/T=abc, where "A" is the absorbance, "T" is the transmittance, "a" is the absorptivity, "b" is the thickness of a solution of the absorbing material, and "c" is the concentration of the absorbing material in the solution. Absorptivity is discussed more fully in Kirk-Othmer Encyclopedia of Chemical Technology, Third Edition, Volume 5, pages 788–789, John Wiley & Sons, N.Y. (1981). Any conventional spectrophotometer can be used to determine absorptivity of the soil release agents of the present invention; a list of typical spectrophotometers is disclosed in Kirk-Othmer Encyclopedia of Chemical Technology, Fourth Edition, Volume 6, page 859, John Wiley & Sons, N.Y. (1993). Absorptivity of the soil release agents of the present invention is given in units of (parts per million-centimeters)$^{-1}$.

Suitable soil release agents have an absorptivity of at least about $1\times10^{-5}$ (ppm-cm)$^{-1}$ in the wavelength range between about 200 nanometers and about 700 nanometers. By this is meant that the soil release agents have at least one absorptivity peak (maximum) of at least $1\times10^{-5}$ (ppm-cm)$^{-1}$ somewhere within this wavelength range. The 200–700 nanometer wavelength range includes the "near ultraviolet" region (about 200–400 nanometers) and most of the "visible" region (about 400–800 nanometers) of the light spectrum. More information on light wavelengths and the measurement of light can be found in the following books: Stearns, "The Practice of Absorption Spectrophotometry", John Wiley & Sons, Inc., New York (1969); Jaffe and Orchin, "Theory and Applications of Ultraviolet Spectroscopy", John Wiley & Sons, Inc. (1962); Bauman, "Absorption Spectroscopy", John Wiley & Sons, Inc. (1962); Lothian "Absorption Spectrophotometry", MacMillan Co., New York (1958); Rao, "Ultra-Violet and Visible Spectroscopy", Plenum Press, New York (1967); and Henderson, "Daylight and Its Spectrum", Adam Hilger Ltd., London (1970).

Example 1

An experiment is conducted to show the dye fading protection benefit from treatment with soil release agents of this invention. Two different groups of colored cotton fabric swatches are used, one group colored red (C86 Red Knight) and the other group colored dark brown (C46 Dark Brown). Three different samples from each group are pretreated by immersion in different deionized water solutions containing 0%, 5% and 10% soil release agent ("SRA"). (The soil release agent is an ester made from sodium 2-( 2-hydroxyethoxy)ethanesulfonate, dimethyl terephthalate, dimethyl 5-sulfoisophthalate, sodium salt, ethylene glycol and propylene glycol according to the process described hereinabove at page 10, line 35 to page 11, line 3, to yield the doubly end-capped ester disclosed hereinabove under d) at pages 12–13. This soil release agent has an absorptivity of 0.045 (ppm-cm)$^{-1}$ at a wavelength of 242 nanometers.) The swatches of fabric are exposed outdoors to direct sunlight, measuring their color variation in a Hunter Color Meter at intervals of sunlight exposure. The results are shown below in Table 1:

TABLE 1

| | Delta E Measurements | | |
|---|---|---|---|
| Hours | 0% SRA | 5% SRA | 10% SRA |
| | Red-Colored Swatches: | | |
| 6 | 1.48 | 0.80 | 0.84 |
| 12 | 1.71 | 2.68 | 1.52 |
| 18 | 2.08 | 2.13 | 1.43 |
| 24 | 3.38 | 3.14 | 3.23 |
| 30 | 3.66 | 3.09 | 1.93 |
| 60 | 9.09 | 4.98 | 4.21 |
| | Brown-Colored Swatches: | | |
| 6 | 0.27 | 1.09 | 0.90 |
| 12 | 0.66 | 1.45 | 1.48 |
| 18 | 1.29 | 2.10 | 2.31 |
| 24 | 1.85 | 2.37 | 2.42 |
| 30 | 2.23 | 2.82 | 3.18 |
| 60 | 8.10 | 5.55 | 4.55 |

The results clearly show a reduced color variation for the cotton swatches pretreated with the soil release agent relative to the original (untreated) swatches. The greatest dye fading protection is provided by the higher level of soil release agent (10% solution). For dark colors like the red and dark brown used in this experiment, a Delta E>1 is a discernible difference. This difference is clearly achieved after 30 hours of sunlight exposure, although for the red-colored swatches this difference is reached earlier. For garments made with these particular colored cotton fabrics, using conservative estimates of sunlight exposure, consumers will notice a significant color fade protection benefit after only four weeks. It is expected that the soil release agent used in this experiment would work as well or better providing dye fading protection for polycotton fabrics (blends of cotton and synthetic fibers) or pure synthetic fabrics, since it is especially designed for deposition on such fabrics.

We claim:

1. A method of reducing dye fading of a fabric comprising depositing on the fabric a soil release agent having an absorptivity of at least about $1\times10^{-5}$ (ppm-cm)$^{-1}$ in the wavelength range between about 200 nanometers and about 700 nanometers, the soil release agent being a water-soluble or water-dispersible soil release agent comprising at least about 10% by weight of a substantially linear sulfonated poly-ethoxy/propoxy end-capped ester having molecular weight ranging from about 500 to about 8,000, the ester consisting essentially of on a molar basis:

i) from about 1 to about 2 moles of sulfonated poly-ethoxy/propoxy end-capping units of the formula: $(MO_3S)(CH_2)_m(CH_2CH_2O)(RO)_n$ — wherein M is a salt-forming cation, m is 0 or 1, R is ethylene, propylene or a mixture thereof, and n is from 0 to 2; and mixture thereof;

ii) from about 0.5 to about 66 moles of units selected from the group consisting of:

a) oxyethyleneoxy units;

b) a mixture of oxyethyleneoxy and oxy-1,2-propyleneoxy units wherein said units are present in an oxyethyleneoxy to oxy-1,2-propyleneoxy mole ratio ranging from 0.5:1 to about 10:1; and c) a mixture of a) or b) with poly(oxyethylene)oxy units wherein said poly(oxyethylene)oxy units have a degree of polymerization of from 2 to 4; provided that when said poly(oxyethylene)oxy units have a degree of polymerization of 2, the mole ratio of poly(oxyethylene)oxy units to total group ii) units ranges from 0:1 to about 0.33:1; and when said poly(oxyethylene)oxy units have a degree of polymerization of 3, the mole ratio of poly(oxyethylene)oxy units to total group ii) units ranges from 0:1 to about 0.22:1; and when said poly(oxyethylene)oxy units have a degree of polymerization of 4, the mole ratio of poly(oxyethylene)oxy units to total group ii) units ranges from 0:1 to about 0.14:1;

iii) from about 1.5 to about 40 moles of terephthaloyl units; and iv) from 0 to about 26 moles of 5-sulfoisophthaloyl units of the formula —(O)C($C_6H_3$)($SO_3M$)C(O)— wherein M is a salt forming cation.

2. The method of claim 1 wherein the ester consists essentially of said units i), ii), iii) and iv); and wherein the ester further has a linear backbone formed from ester-bond connected units ii), iii) and iv).

3. The method of claim 2 wherein the soil release agent comprises from about 25% to about 100% by weight of ester having the empirical formula $(CAP)_x(EG/PG)_y(T)_z(SIP)_q$; wherein (CAP) represents the sodium salt form of said sulfonated end-capping units i); (EG/PG) represents said oxyethyleneoxy, oxy-1,2-propyleneoxy and poly(oxyethylene)oxy units ii); (T) represents said terephthaloyl units iii); (SIP) represents the sodium salt form of said 5-sulfoisophthaloyl units iv); x is from about 1 to 2; y is from about 0.5 to about 66; z is from about 1.5 to about 40; q is from about 0.05 to about 26; wherein x, y, z and q represent the average number of moles of the corresponding units per mole of said ester.

4. The method of claim 3 wherein x is about 2, y is from about 3 to about 18, and z is from about 3 to about 15, and q is from about 0.5 to about 4.

5. The method of claim 4 wherein x is about 2, y is about 5, z is about 5, and q is about 1, and wherein the sulfonated end-capping units are sodium 2-(2-hydroxyethoxy)ethanesulfonate,

6. The method of claim 1 wherein the esters consist essentially of those in the doubly end-capped form comprising about 2 moles of said end-capping units per mole of said ester, the end-capping units being selected from the group consisting of sodium isethionate, sodium 2-( 2-hydroxyethoxy)ethanesulfonate, sodium 2-(2-(2-hydroxyethoxy-)ethoxy)ethanesulfonate, sodium 5-hydroxy-4-methyl-3-oxa-pentanesulfonate, sodium alpha-3-sulfopropyl-omega-hydroxy-poly(oxy- 1,2-ethanediyl) (with average degree of ethoxylation of 1– 2), sodium 5-hydroxy-3-oxa-hexanesulfonate, and mixtures thereof.

7. The method of claim 3 wherein the agent comprises at least about 50% by weight of said ester having a molecular weight ranging from about 500 to about 5000.

8. The method of claim 4 wherein the agent comprises at least about 50% by weight of said ester having a molecular weight ranging from about 500 to about 5000.

9. A method of reducing dye fading of a fabric comprising depositing on the fabric a soil release agent having an absorptivity of at least about $1\times10^{-5}$ (ppm-cm)$^{-1}$ in the wavelength range between about 200 nanometers and about 700 nanometers, the soil release agent being a water-soluble or water-dispersible soil release agent comprising at least about 10% by weight of a substantially linear end-capped ester having molecular weight ranging from about 500 to about 8000, the ester consisting essentially of on a molar basis:

i) from about 1 to about 2 moles of two or more end-capping units selected from the group consisting of:

a) ethoxylated or propoxylated hydroxy-ethane and propanesulfonate end-capping units of the formula $(MO_3S)(CH_2)_m(CH_2CH_2O)(RO)_n$—, wherein M is a salt-forming cation such as sodium or tetraalkylammonium, R is ethylene or propylene or a mixture thereof, m is 0 or 1, and n is from 0 to 4;

b) sulfoaroyl units of the formula —(O)C($C_6H_4$)($SO_3M$), wherein M is a salt forming cation;

c) modified poly(oxyethylene)oxy monoalkyl ether units of the formula $XO(CH_2CH_2O)_k$—, wherein X is alkyl containing from about 1 to about 4 carbon atoms and k is from about 1 to about 100; and d) ethoxylated or propoxylated phenolsulfonate end-capping units of the formula $NaO_3S(C_6H_4)(RO)_n$—, wherein n is from 1 to 5 and R is ethylene or propylene or a mixture thereof;

ii) from about 0.5 to about 66 moles of units selected from the group consisting of:

a) oxyethyleneoxy units;

b) oxy-1,2-propyleneoxy units; and c) mixtures of a) and b);

iii) from 0 to about 50 moles of di(oxyethylene)oxy units;

iv) from 0 to about 50 moles of poly(oxyethylene)oxy units with a degree of polymerization of at least 3;

v) from about 1.5 to about 40 moles of terephthaloyl units;

vi) from about 0.05 to about 26 moles of 5-sulfoisophthaloyl units of the formula —(O)C($C_6H_3$)($SO_3M$)C(O)—, wherein M is a salt forming cation; such that the total units of ii), iii), and iv) ranges from about 0.5 to about 66 moles and such that no more than 50% by weight of the ester is derived from the poly(oxyethylene)oxy units and modified poly(oxyethylene)oxy end-capping units and such that the total of units iii) and iv) is no more than 75% of the total of units ii), iii), and iv).

10. The method of claim 1, 5, 7 or 9 wherein the soil release agent is deposited on the fabric during a laundering or drying operation.

11. The method of claim 1, 5, 7 or 9 wherein the soil release agent is deposited on the fabric at a weight ratio of soil release agent to fabric of between about 1:10,000 and about 1:1000.

12. The method of claim 1, 5 or 7 wherein the fabric is selected from the group consisting of polyester, cotton, and blends of polyester and cotton; and wherein color of the fabric is selected from the group consisting of red, brown, violet, and shades thereof.

* * * * *